US008707634B2

(12) United States Patent
Anklam

(10) Patent No.: US 8,707,634 B2
(45) Date of Patent: Apr. 29, 2014

(54) COLLAPSIBLE MODULAR BUILDING WITH CANVAS SEAMS

(75) Inventor: Edward D. Anklam, Culbertson, MT (US)

(73) Assignee: Edward D. Anklam, Culbertson, MT (US)

( * ) Notice: Subject to any disclaimer, the term of this patent is extended or adjusted under 35 U.S.C. 154(b) by 103 days.

(21) Appl. No.: 13/360,754

(22) Filed: Jan. 29, 2012

(65) Prior Publication Data

US 2013/0192146 A1 Aug. 1, 2013

(51) Int. Cl.
*E04H 1/00* (2006.01)

(52) U.S. Cl.
USPC ..... 52/79.8; 52/79.1; 52/79.5; 52/79.9

(58) Field of Classification Search
USPC ..... 52/79.1, 79.5, 79.7, 79.9, 79.8; 49/504
See application file for complete search history.

(56) References Cited

U.S. PATENT DOCUMENTS

| | | | | |
|---|---|---|---|---|
| 1,100,278 | A | 6/1914 | Wiard | |
| 2,287,025 | A * | 6/1942 | Christianson | 105/15 |
| 2,293,569 | A * | 8/1942 | Sonion | 52/71 |
| 2,883,713 | A * | 4/1959 | Zug | 52/71 |
| 3,044,129 | A | 7/1962 | Bigelow | |
| 3,494,092 | A * | 2/1970 | Bottjer et al. | 52/745.14 |
| 3,826,270 | A * | 7/1974 | Hentges | 280/19.1 |
| 3,854,746 | A * | 12/1974 | Flynn et al. | 280/19.1 |
| 4,068,437 | A * | 1/1978 | Byxbe et al. | 52/464 |
| 4,112,633 | A * | 9/1978 | Mitchell | 52/66 |
| 4,369,600 | A * | 1/1983 | Passovoy | 49/504 |
| 4,655,012 | A * | 4/1987 | Downey et al. | 52/79.8 |
| 4,742,653 | A * | 5/1988 | Napier et al. | 52/66 |
| 4,779,514 | A * | 10/1988 | Prigmore et al. | 52/79.5 |
| 4,794,206 | A * | 12/1988 | Weinstein | 174/371 |
| 4,843,788 | A * | 7/1989 | Gavin et al. | 52/205 |
| 4,858,398 | A * | 8/1989 | Ricchini | 52/91.3 |
| 4,866,833 | A * | 9/1989 | Ward | 29/445 |
| 4,930,257 | A * | 6/1990 | Windgassen | 49/504 |
| 4,989,379 | A | 2/1991 | Suzuki | |
| 5,394,897 | A * | 3/1995 | Ritchey et al. | 135/124 |
| 5,444,944 | A | 8/1995 | Roelofsz | |
| 5,592,960 | A * | 1/1997 | Williams | 135/87 |
| 5,609,003 | A * | 3/1997 | Jouty | 52/585.1 |
| 5,974,757 | A * | 11/1999 | Whitney et al. | 52/586.1 |
| 6,032,421 | A * | 3/2000 | Yamada | 52/79.8 |
| 6,253,498 | B1 | 7/2001 | Fanucci | |
| 6,343,448 | B1 * | 2/2002 | Lin | 52/204.1 |
| 6,766,619 | B1 * | 7/2004 | Franz | 52/79.5 |
| 6,948,280 | B2 | 9/2005 | Marcinkowski et al. | |
| 6,968,653 | B2 | 11/2005 | Stapleton, Jr. et al. | |
| 7,076,922 | B1 * | 7/2006 | Parres | 52/79.5 |
| 7,543,864 | B2 * | 6/2009 | Barthel | 292/340 |

(Continued)

*Primary Examiner* — Joshua J Michener
*Assistant Examiner* — Matthew Gitlin
(74) *Attorney, Agent, or Firm* — Antoinette M. Tease

(57) ABSTRACT

A collapsible structure comprising four collapsible walls and a roof member, each of the four walls and roof member comprising two foam panels joined by a canvas seam. The canvas seam extends along one side of each foam panel. The invention further comprises vinyl flashing around all or part of the perimeter of each foam panel except on the side of the foam panel where the canvas seam is located. Preferably, the canvas seam is comprised of duck canvas.

2 Claims, 15 Drawing Sheets

(56) References Cited

U.S. PATENT DOCUMENTS

| | | | | |
|---|---|---|---|---|
| 7,562,508 | B2 | 7/2009 | Dickinson et al. | |
| 7,673,422 | B2 * | 3/2010 | De La Marche | 52/79.8 |
| 2003/0140573 | A1 | 7/2003 | Marcinkowski et al. | |
| 2005/0066588 | A1 | 3/2005 | Stapleton, Jr. et al. | |
| 2006/0260215 | A1 | 11/2006 | Jankovskis et al. | |
| 2008/0034676 | A1 | 2/2008 | Ahmad | |
| 2009/0056237 | A1 | 3/2009 | Dickinson et al. | |
| 2010/0116442 | A1 * | 5/2010 | Pottmeyer et al. | 160/136 |

* cited by examiner

COLLAPSIBLE MODULAR BUILDING WITH CANVAS SEAMS

BACKGROUND OF THE INVENTION

1. Field of the Invention

This invention relates generally to the field of collapsible structures, and more specifically, to a collapsible and modular structure that may be used for hunting, fishing and other outdoor activities.

2. Description of the Related Art

There are a number of contraptions for providing temporary shelter during hunting and fishing trips or other outdoor excursions, as well as during times of emergency or housing shortages. Most of these shelters are in the form of tents or blinds that are un-insulated, unheated, and not modular (i.e., they cannot be expanded upon). Collapsible structures exist, but not all of them are portable, some require machinery to assemble, and others have joint systems that are overly complicated, expensive to manufacture and/or unable to withstand repeated exposure to harsh outdoor weather conditions.

The present invention is intended to replace the typical collapsible and mostly flimsy camping tent with a rigid and sturdy outdoor structure for the outdoor enthusiast who desires a feasible alternative to the too-often cramped and less-than-comfortable confines of a tent. The present invention allows for storage of gear without taking up valuable space. It also provides a relatively cool environment in the summer and a relatively warm environment in the winter because it incorporates insulation and can accommodate a heater. Because the present invention is insulated, it also filters out unwanted noise from the outside environment.

Because of its modular structure, the present invention allows multiple individuals or groups to each have their own room, which provides greater privacy than is afforded with a typical tent. Another advantage of the present invention is that people may stand upright inside of the structure, which makes it feel more like a house than a tent and makes it more habitable for prolonged periods. Lastly, the present invention provides much greater protection from the elements than a standard tent. Examples of prior art structures are described below, but none of these inventions incorporates the structural features and functional advantages of the present invention.

U.S. Pat. No. 1,100,273 (Wiard, 1914) covers a collapsible room in which each end wall is made of two members hinged to one another by hinges so that they fold inwardly upon one another. The end members are hinged at their outer edges to the side walls by hinges that permit the end members to fold outwardly. The hinges shown in the drawings are typical metal hardware butt hinges. The room is not designed to be insulated, nor is it closed to the outside environment. In fact, the room is specifically designed to allow fresh air to penetrate into the interior through the underside of the roof. See col. 2, lines 83-87 ("A very important feature of my invention resides in the fact that the cover frame overhangs the chamber on all sides, so that fresh air can enter within, and escape from below, the cover."). This invention was intended to serve as an outdoor sleeping chamber in relatively mild climates.

U.S. Pat. No. 3,044,129 (Bigelow, 1962) discloses a portable building with a relatively complex joinder system. The invention includes a floor comprised of two outer, tray-like sections that form a container for carrying the structure when it is disassembled. To erect the building, the tray-like sections of the floor are placed on the ground with their tops down and their bottoms elevated above the ground so that the side walls may be positioned with the lower edges of the lower wall sections seated along the side margins of the floor. To secure the walls to the floor, hooks are pivotally secured to the lower margins of the walls and engage with bolts that extend through the sides of the tray-like sections and upon which wing nuts are situated. The side walls are secured together at the corners of the structure by corner posts comprised of an upright strip with longitudinally extending "V" notches positioned for engagement with the vertical edges of two of the walls at a corner. A bolt extends through aligned openings in the corner posts and the inside corner strip to hold the corner post and strip in alignment. The roof is comprised of a flexible material such as canvas.

U.S. Pat. No. 3,494,092 (Johnson et al., 1970) involves an integrated folding slab construction unit for forming permanent building structures. The roof assembly is formed in a horizontal mold, and the walls panels are connected to the roof assembly by ductile structural members embedded in both the ceiling and wall panels. These ductile hinges are comprised of a reinforcing rod or re-bar made of mild structural steel. When the ceiling panel is lifted, the wall panels fall into a vertical position with their upper edges underlying the bottom edges of the ceiling panel. Bonding plates are mounted on abutting edges of adjacent panels to provide structural integrity. Bendable moisture-sealing flanges are used to provide positive moisture sealing after the panels have been moved to their relative angular relationship in the completed structure.

U.S. Pat. No. 4,782,653 (Napier et al., 1988) provides a collapsible structure that is also modular. The structure comprises a steel-framed base formed of two parallel C beams held together by a number of C beam cross members with uprights at each of its four corners. Each upright is a square tube welded to the base. Upon erection, the walls are locked into place with pins that extend through holes in the uprights. The walls also pivot on additional pins in the uprights when they are raised from the flat transport position to the erect position. The walls are preferably comprised of metal clad polystyrene panels, and the roof is a metal clad polystyrene panel that is hinged to the top of one of the side walls with metal hinges. The base is designed to allow the entire structure to be carried by a forklift. To form a modular structure, the bases of two individual structures are placed adjacent to one another, the adjacent walls are eliminated, and the roofs are joined.

U.S. Pat. No. 4,989,379 (Suzuki, 1991) describes a folding house with a folding roof, folding side walls and folding floor. Each of these components comprises metallic butt hinges that allow the components to fold along their center lines. Two of the wall panels are fixed, two of the wall panels are moveable, and all of the wall panels have bracing members. The fixed wall panels are connected to the roof panel and to the floor with butt hinges. To erect the house, the structure is pulled upward by a crane via cables that extend through fittings on the top side of the roof, causing the roof to open due to the upward pull and the floor panel to open by its own weight. Next, the folded movable wall panels are opened by hand and fixed in place with locking bolts. Two folding houses may be connected side by side, or alternately, one house may be stacked on top of another as a second floor. Waterproofing is provided by using waterproof sealant on the butt hinges.

U.S. Pat. No. 5,444,944 (Roelofsz, 1995) shows a collapsible enclosure with base elements of progressively increased heights, each base element having a wall hinged thereto. The base elements differ in height from each other in accordance with the thickness of the walls. The walls are pivotally attached to the base elements with, recessed metal hinges. Once the walls are raised, they are secured in an upright position by lowering downwardly-oriented pins on the roof element into a channeled or square tubular frame in the top edges of the walls. Two or more units may be joined to form a larger enclosure, in which case one or more of the walls would be omitted.

U.S. Pat. No. 6,253,498 (Fanucci, 2001) covers a modular building system comprising various panels that fold for shipping. The floor is connected to the side wall by a hinge that is located in one embodiment at some distance from the intersection of the floor and side wall and in another embodiment at the intersection of the floor and side wall. A gasket connects multiple floor panels to each other. Center jacks are used to increase the rigidity and load capacity of the floor. Panel sets of linked side wall and roof panels are unfolded, and the left and right roof panels are joined (preferably with a gasket) to form the peak of the structure. Where the panels fold against each other, hinges or other joining means are employed. The structure itself contains no end walls; instead, the side wall of a shipping container is used as the end wall.

U.S. Pat. No. 6,948,280 (Marcinkowski et al., 2005) discloses a portable enclosure with a floor that is hingedly connected to an interconnecting panel. The walls of the structure are secured to the floor from by extending upward from within a recessed channel in the outer perimeter of the floor panel(s). Each wall panel has an annular shaped projection along one of its side edges, and a corresponding annual shaped recess extends along another side edge. The wall panels are connected to each other by placing the annular shaped projection of one wall panel into the annular shaped recess of an adjacent wall panel. The end walls are hinged and triangular-shaped. The roof is constructed of a first rigid panel and a second interconnecting rigid panel that is secured to the upper perimeter of the interconnected walls.

U.S. Pat. No. 6,968,653 (Stapleton, Jr. el al., 2005) involves a folding modular structure comprising a top panel, two side panels, a front and a rear panel. Spacer panels are interposed between three of the four total side, front and rear panels and provide clearance so that each of the panels can be folded onto the other already folded panels. The panels themselves do not fold, however. The side spacer panels are perpendicular to the sides of the top panel and are pivotally connected to the side panels. To install the structure, a crane, large forklift or other lifting mechanism lifts the entire structure (preferably by the corners of the top panel) so that the panels unfold into an open position.

U.S. Patent Application Pub. No. 2006/0260215 (Jankovskis et al.) provides a temporary shelter for disaster victims and comprises two side walls, two end walls, a roof and a floor. The two end walls are connected to the floor such that they fold upward from the floor to form the end walls. This part (the floor and end walls) is constructed of a double-skinned polyethylene or other plastic material that has cross ribs extending internally between the two skins (the commercial name of this material is TWINPLAST™). One of the skins of this material is cut or scored to allow the part to fold, thereby creating a hinge out of the second skin. A second part, made of the same material as the first part, forms the roof and side walls and also has a floor. The material is similarly scored and folded to form the roof, side walls and floor. An overlapping roof part is connected to one of the side walls with rivets, adhesive or welding. The two floor parts are connected by fasteners, adhesive and/or welding.

U.S. Patent Application Pub. No. 2008/0034676 (Ahmad) describes a folding house in which all four walls fold inward onto the floor. The walls themselves are not foldable, however, and the side walls are connected to the front and rear walls with a slip-on bracket. Simple door hinges connect the walls to the floor. The roof is fitted on top of the four walls and tethered to the floor with metallic rods that have fitted ends at the floor and ceiling. A waterproofing guard is fitted on top of the roof.

U.S. Pat. No. 7,562,508 (Dickinson et al.) shows a shelter comprised of a roof, floor and plurality of side walls in, which at least one of the floor, roof and side walls has both an exterior panel and an interior panel. An attachment device secured to the exterior and interior panels allows the panels to move between collapsed and expanded positions in which the exterior and interior panels are parallel to one another. The attachment device comprises a first plate coupled to the exterior panel, a second plate coupled to the interior panel, and a third plate pinned to the first and second plates, respectively, for relative rotation between the third plate and the first plate about a first axis of rotation and relative rotation between the third plate and the second plate about a second axis of rotation. The third plate pivots between a position in which it is oblique to the first and second plates (when the exterior and interior panels are in a collapsed position) and a position in which it is perpendicular to the first and second plates (when the exterior and interior panels are in an expanded position). In the expanded position, filler material is injected into the cavity between the exterior and interior panels. Connectors secure one set of panels to another to form the shelter.

BRIEF SUMMARY OF THE INVENTION

The present invention is a collapsible structure comprising four collapsible walls and a collapsible roof member, each of the four walls and collapsible roof member comprising two foam panels joined by a canvas seam. In a preferred embodiment, each foam panel comprises a perimeter, the canvas seam extends along one side of each foam panel, and the invention further comprises vinyl flashing around all or part of the perimeter of each foam panel except on the side of the foam panel where the canvas seam is located. Preferably, the canvas seam is comprised of duck canvas.

In a preferred embodiment, each wall comprises an interior face, and the interior face of each wall is covered with duck canvas. In yet another preferred embodiment, each wall comprises an exterior face, and the exterior face of each wall is covered with 600-denier polyester tent-grade material. The walls are preferably joined together by threaded bolts.

In a preferred embodiment, the invention further comprises a plurality of nylon bushings inserted into the foam panels to stabilize bolts that join the walls together and to prevent the foam panels from collapsing when the bolts are tightened. In yet another preferred embodiment, the invention further comprises a plurality of fastening blocks installed into the foam panels to anchor bolts that join the walls together and to prevent the foam panels from collapsing when the bolts are tightened.

Preferably, one of the walls comprises a pull-down shelf. One of the walls preferably comprises a medicine cabinet. One of the walls preferably comprises a window. One of the walls preferably comprises a bracket for a portable heater. One of the walls preferably comprises a conduit for electrical cables. One of the walls preferably comprises a coat/towel rack. In a preferred embodiment, the roof member comprises at least one fastening block.

In a preferred embodiment, the canvas seam is comprised of a first strip of canvas that has a first length and that is adhered to two adjacent panels along one side of each of the two adjacent panels and on a first face of each of the two adjacent panels, the two adjacent panels have two abutting edges, the canvas seam is further comprised of a second strip of canvas that has a second length and that is adhered to the two adjacent panels along the same side of each of the two adjacent panels and on a second face of each of the two adjacent panels and also to the two abutting edges of the two adjacent panels, and the second length is greater than the first length.

In a preferred embodiment, the invention further comprises a door frame, a boot and a plurality of boot locks; wherein the boot is roughly the same shape and size as the door frame; wherein the boot comprises a frame with a first side and a second side, a rubber gasket that is joined to the first side of the frame, and a rubber gasket that is joined to the second side of the frame; wherein each boot lock is a bracket comprising a longitudinal section and two end sections that protrude from either end of the longitudinal section at roughly ninety-degree angles; and wherein each boot lock is roughly the width of the boot plus two walls. Preferably, the boot and boot locks join two collapsible structures together, and the rubber gaskets create a seal between the two structures.

REFERENCE NUMBERS

Figure 1:
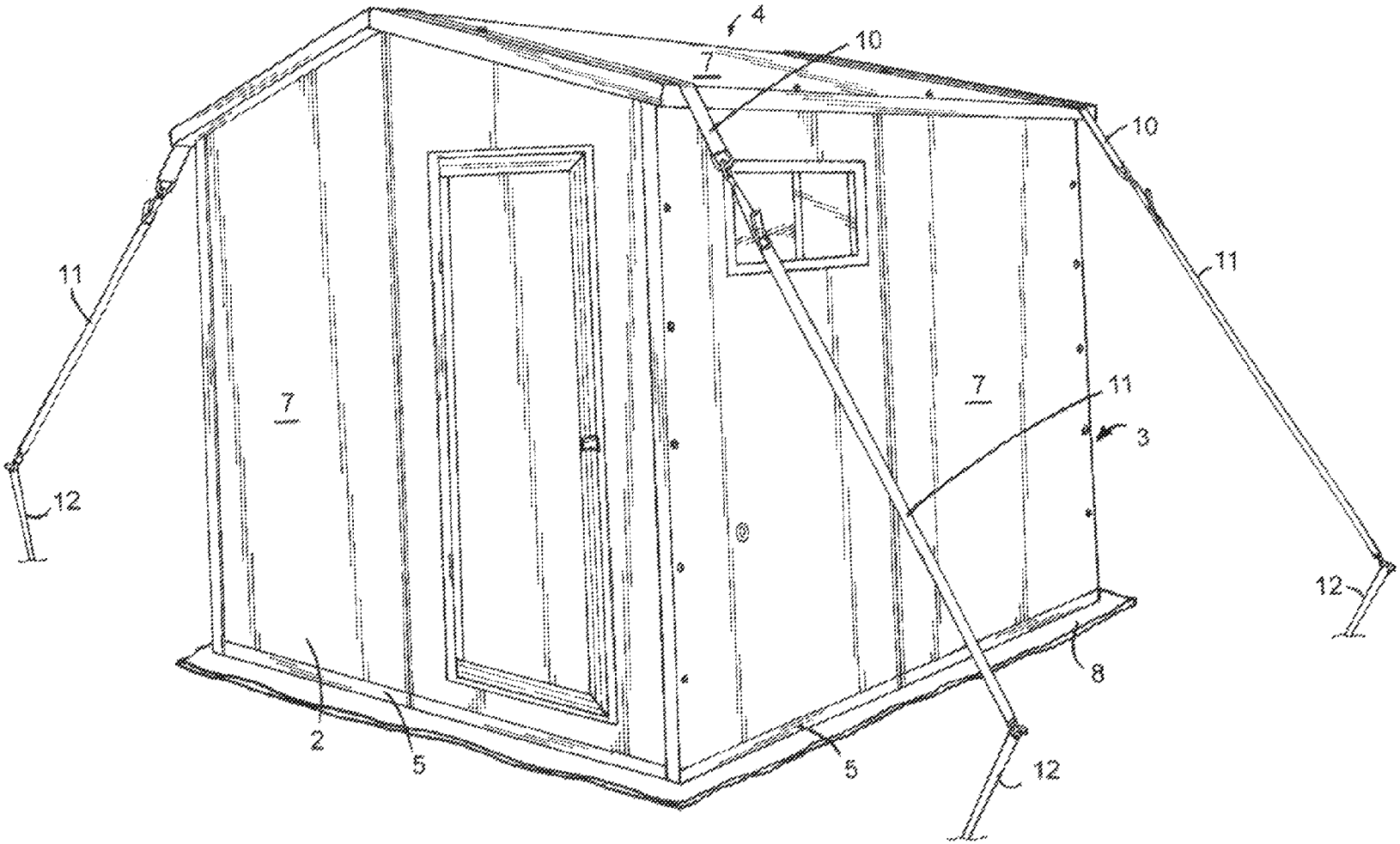
FIG. 1 is a perspective view of the present invention fully installed.

1 Front wall
2 Rear wall
3 Side wall
4 Roof member
5 Vinyl flashing
6 Duck canvas
7 Tent-grade polyester material
8 Tarp
9 Bolt
10 Roof tie
11 Ratchet strap
12 Ground anchor
13 Door
**13*a*** Door frame
14 Canvas seam
15 Pin hinge
16 Heavy-duty canvas strap (pull)
17 Weather-stripping
18 Shelf
19 Shelf frame
20 Cut-out (in shelf)
21 Medicine cabinet
22 Medicine cabinet door
23 Medicine cabinet frame
24 Window
25 Window frame
26 Heater bracket
27 Conduit
28 Grommet hole
29 Coat/towel rack
**29*a*** Coat/towel rack frame
30 Peg (of coat/towel rack)
31 Mirror
32 Fastening block
**32*a*** Threaded metal insert
**32*b*** Wood block
33 Hook
34 Boot
35 Frame (of boot)
36 Corner bracket (on boot frame)
37 Rubber gasket
38 Boot lock
39 Longitudinal section (of boot lock)
40 End section (of boot lock)
41 Metal washer
42 Rubber washer
43 Nylon bushing
44 Foam panel

DETAILED DESCRIPTION OF INVENTION

Figure 2:
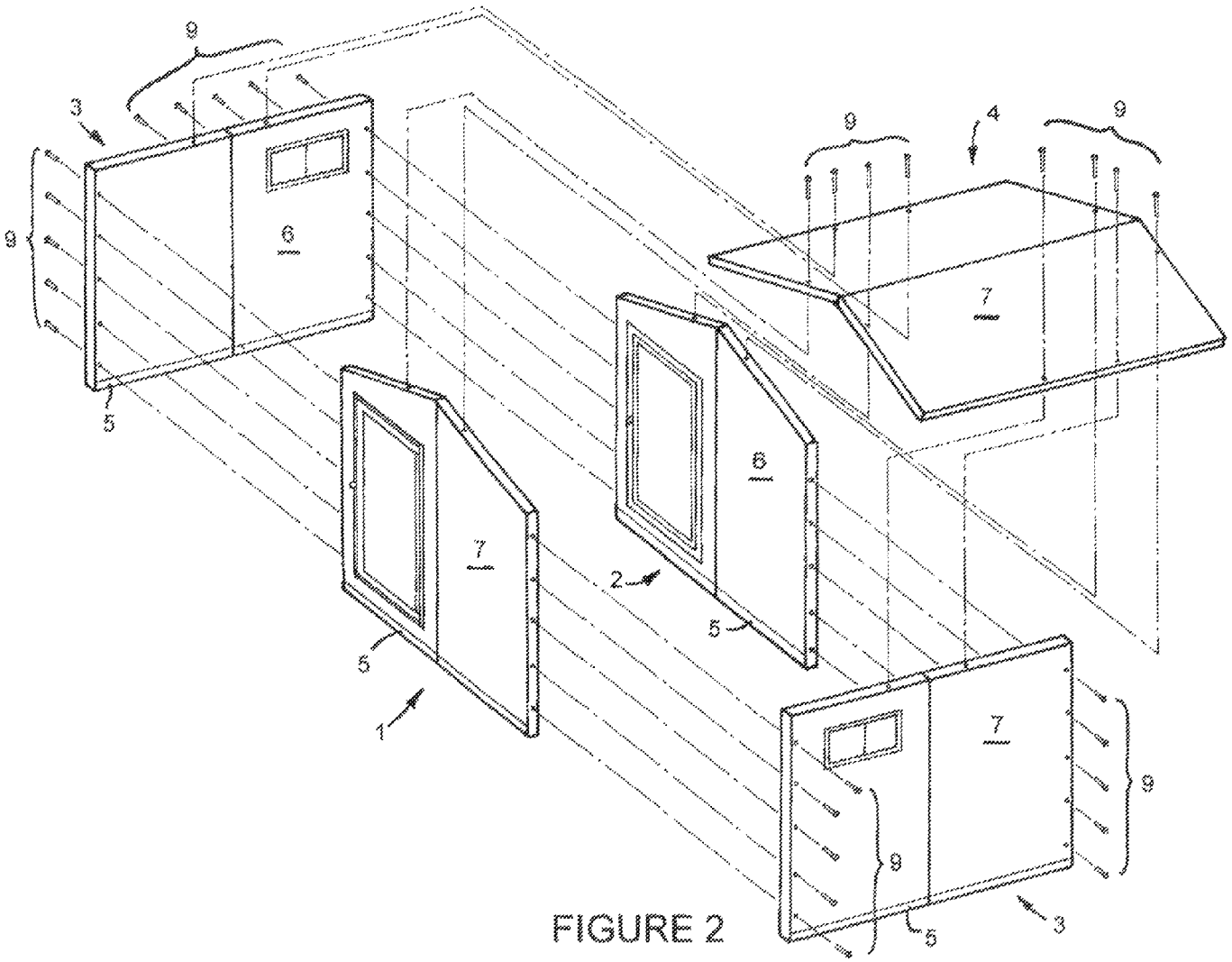
FIG. 2 is an exploded view of the present invention shown without the roof ties and ratchet straps.

FIG. 1 is a perspective view of the present invention fully installed. FIG. 2 is an exploded view of the present invention shown without the roof ties and ratchet straps. As shown in these two figures, the invention comprises a front wall 1, a rear wall 2, two side walls 3, and a roof member 4. Each of these walls and the roof member is foldable along a canvas seam (shown and discussed more fully in connection with FIG. 15) that runs longitudinally through the center of each wall or roof member. The roof member 4 and side walls 3 are rectangular in shape, whereas the front and rear walls 1, 2 are peaked at the center of the top side of the wall (i.e., the canvas seam runs to the apex of the wall).

Each of the four walls and roof member is preferably comprised of two flat panels 44 (labeled in FIGS. 15, 19, 20 and 23) of polyisocyanurate foam core bonded on each side to fiber-reinforced facers and joined together by a canvas seam. This product is sold by Hunter Panels LLC of Portland, Me. under the product name POLYISO™. Alternately, the foam panels may be comprised of expanded polystyrene or any other suitable foam product. In a preferred embodiment, the panels are 2.50 inches (64 millimeters) in thickness with a long-term thermal resistance value ("R value") of 15.30. The POLYISO™ product has a compressive strength of 20 psi minimum, a dimensional stability of 2% linear change over seven days, a moisture vapor transmission rate of less than 1% permeability, a water absorption rate of less than 1% volume, and a service temperature of −100° to 250° F. (−73° to 122° C.). Each individual panel weighs approximately 21 pounds.

Each panel is framed around its perimeter (except on the side that forms the canvas seam 14) with vinyl flashing 5 and then covered on the inside (i.e., the panel face that is on the interior of the structure) with 12-ounce duck canvas 6 and on the outside (i.e., the panel face that is on the exterior of the structure) with 600-denier polyester tent-grade material 7. The vinyl flashing 5 around the perimeter of each panel is on the inside of the duck canvas 6 and tent-grade material 7 except at the bottom of each wall panel, where the vinyl flashing 5 is on the outside of the duck canvas 6 and tent-grade material 7 to protect the canvas/material from contact with the ground. Preferably, a tarp 8 is laid on the ground, and the entire structure is placed upon the tarp 8, which serves as the floor of the structure.

To install the structure, one of the two side walls 3 and either the front or, rear 1, 2 wall is unfolded and placed upon the tarp with the side edge of one of the side walls abutting up against the side edge of either the front or rear wall. Threaded bolts 9 are inserted into grommet holes in the side edge of each side wall and screwed into corresponding grommet holes in the side edge of the front or rear wall with washers (not shown) situated directly underneath the head of each bolt between the bolt head and the outer covering 7 (i.e., the 600-denier polyester tent-grade material). Once one side wall has been attached to the front or rear wall in this manner, the other side wall can be attached to the other side of the same front or rear wall in the same manner. When both side walls have been attached to the front or rear wall, then the unattached front or rear wall (whichever the case may be) can be attached to the other (unattached) sides of the two side walls in the same fashion.

After all four walls have been bolted together, the roof member 4 is placed on top of the four walls such that the canvas seam through the center of the roof member is aligned with the peak of each of the front and rear walls. Two roof ties 10 made of heavy-duty canvas are positioned across the top of the roof member, and threaded bolts 9 are inserted through grommet holes in the roof ties 10 and grommet holes located on either side of the canvas seam of the roof member 4 on the perimeter of the roof member and screwed into grommet holes on the top edges of the front and rear walls 1, 2 located on either side of the canvas seam of the front and rear walls. Threaded bolts 9 are also inserted through grommet holes located on the perimeter of the roof member 4 directly above the top edges of the side walls 3 and screwed into grommet holes on the top edges of the side walls 3. Next, ratchet straps 11 are secured to the roof ties 10 on one end and to ground anchors 12 on the other end and ratcheted down to create a seal around the structure.

Figure 3:
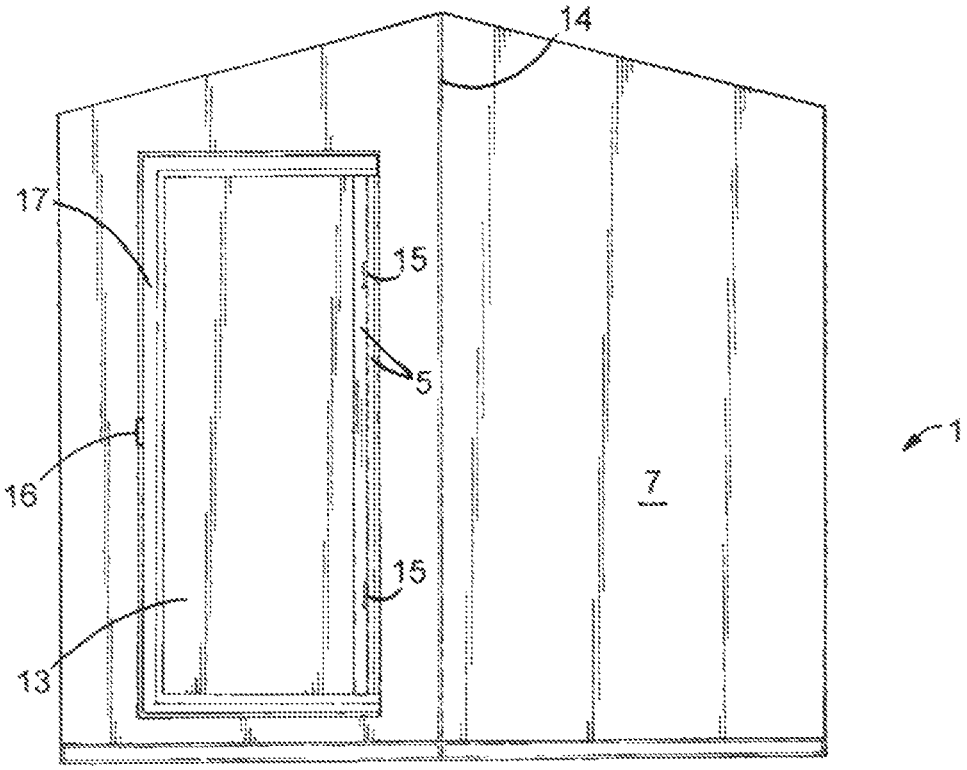
FIG. 3 is a front view of the front wall of the present invention.
Figure 4:
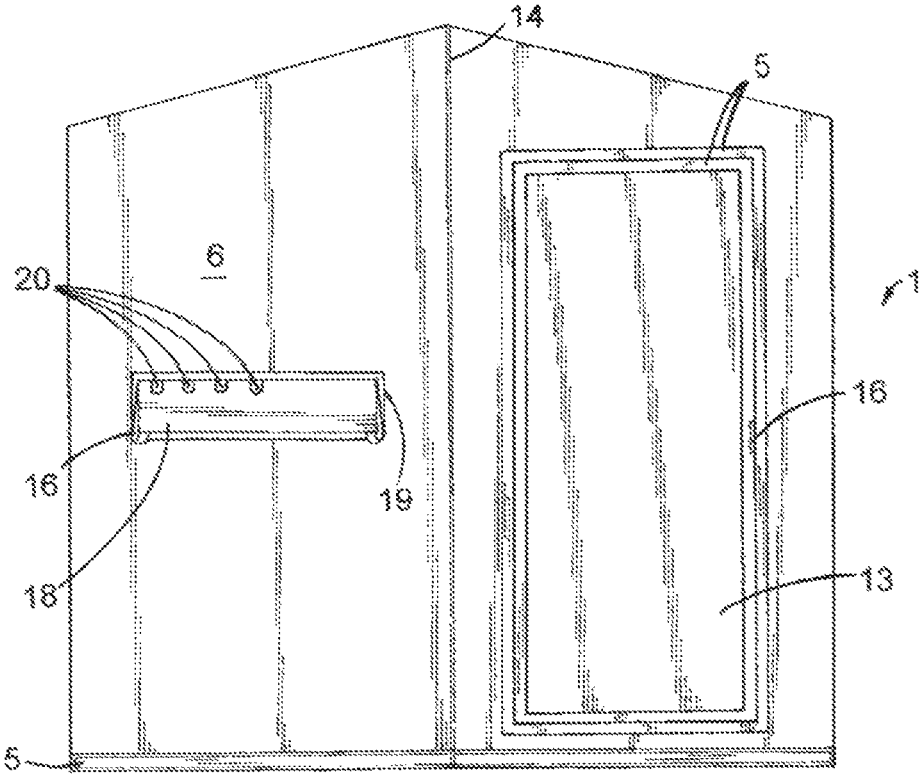
FIG. 4 is a rear view of the front wall of the present invention.

FIG. 3 is a front view of the front wall of the present invention, and FIG. 4 is a rear view of the front wall of the present invention. The front view shows the outer (exterior) face of the front wall 1, and the rear view shows the inner (interior) face of the front wall 1. As noted above, the outer face of the front wall 1 is preferably covered with 600-denier polyester tent-grade material 7, and the inner face of the front wall 1 is preferably covered with 12-ounce duck canvas 6. As shown in this figure, the front wall 1 preferably comprises a door 13 that is situated inside of a door frame 13*a* in one of the two panels that make up the front wall (the two panels being separated by a canvas seam 14). The door 13 is comprised of the same material as the walls and roof member, and it is secured to the door frame with pin hinges 15. Heavy-duty canvas straps 16 are used as door handles (to open and close the door). The door frame and the door itself are preferably lined with vinyl flashing 5. The outside perimeter of the door is preferably partially covered with weather-stripping 17.

In a preferred embodiment, the inner face of the front wall 1 comprises a pull-down shelf 18 that pivots outward from the front wall when in use and pivots inward and is stowed inside the front wall when not in use (in other words, the shelf is flush with the inner face of the front wall when in a stowed position). The shelf pivots outward/inward on barrel hinges (not shown) that are attached to both the shelf 18 and the wood frame 19 around the shelf. The shelf 18 preferably comprises cut-outs 19 that can serve to hold guns or fishing rods when the shelf is pulled down (see FIG. 12). Pulls 16 made of heavy-duty canvas are used to pull the shelf downward and outward. Ammunition, fishing tackle or other items may be placed upon the shelf when it is in use.

Figure 5:
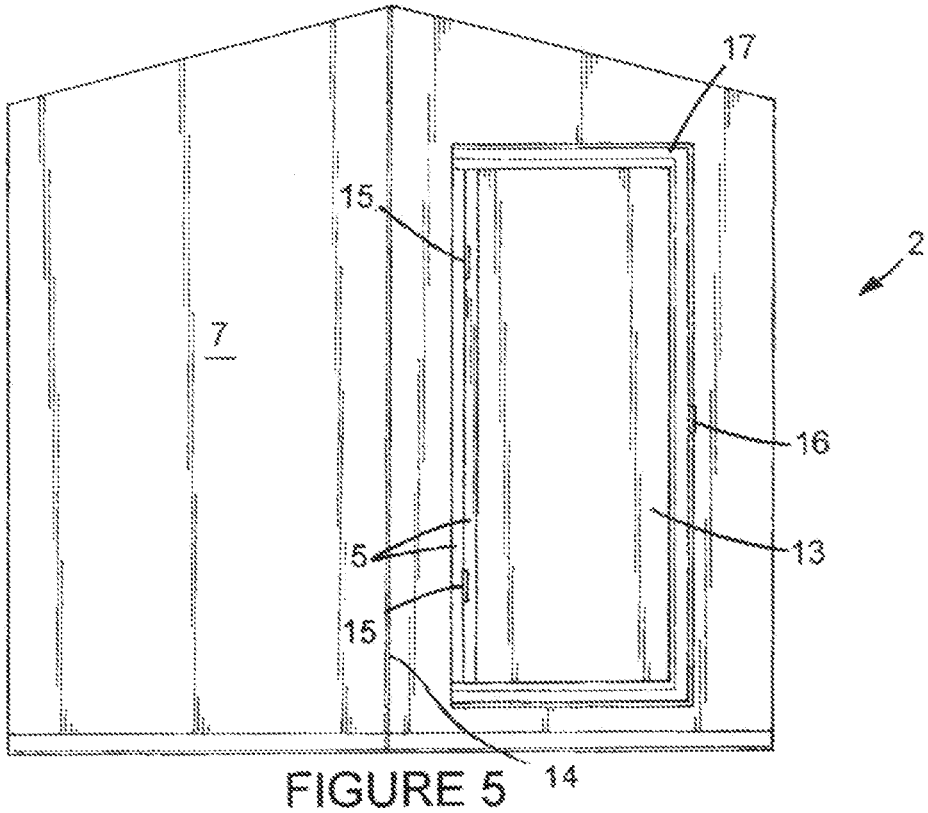
FIG. 5 is a front view of the rear wall of the present invention.
Figure 6:
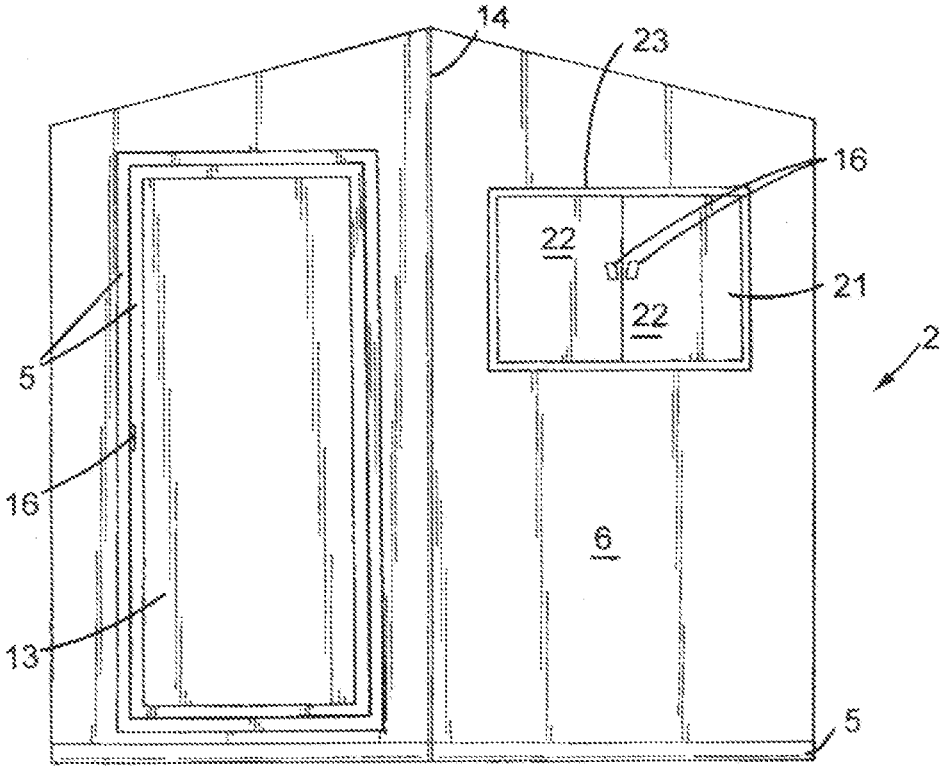
FIG. 6 is a rear view of the rear wall of the present invention.

FIG. 5 is a front view of the rear wall of the present invention, and FIG. 6 is a rear view of the rear wall of the present invention. The front view shows the outer (exterior) face of the rear wall 2, and the rear view shows the inner (interior) face of the rear wall 2. As noted above, the outer face of the rear wall 1 is preferably covered with 600-denier polyester tent-grade material 7, and the inner face of the rear wall 1 is preferably covered with 12-ounce duck canvas 6. As shown in this figure, the rear wall 1 preferably comprises a door 13 that is situated inside of a door frame in one of the two panels that make up the rear wall (the two panels being separated by a canvas seam 14). The door 13 is comprised of the same material as the walls and roof member, and it is secured to the door frame with pin hinges 15. Heavy-duty canvas straps 16 are used as door handles (to open and close the door). The door frame and the door itself are preferably lined with vinyl flashing 5. The outside perimeter of the door is preferably partially covered with weather-stripping 17.

In a preferred embodiment, the inner face of the rear wall 2 comprises a medicine cabinet 21 that is recessed into the interior of the rear wall. The medicine cabinet 21 comprises two outwardly swinging doors 22, the insides of which comprise shelves for storage of first aid supplies and other personal items (see FIG. 11). The medicine cabinet doors 22 are preferably secured to the medicine cabinet frame 23 with hinges (not shown). The medicine cabinet is opened with pulls 16 made of heavy-duty canvas.

Figure 7:
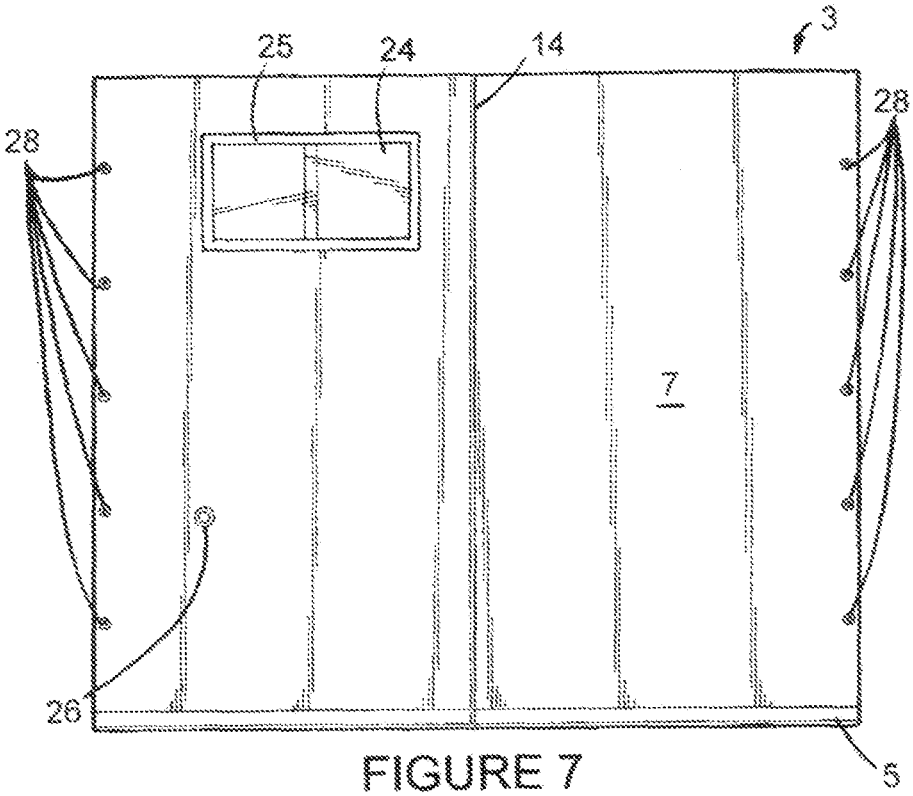
FIG. 7 is a front view of a first side wall of the present invention.
Figure 8:
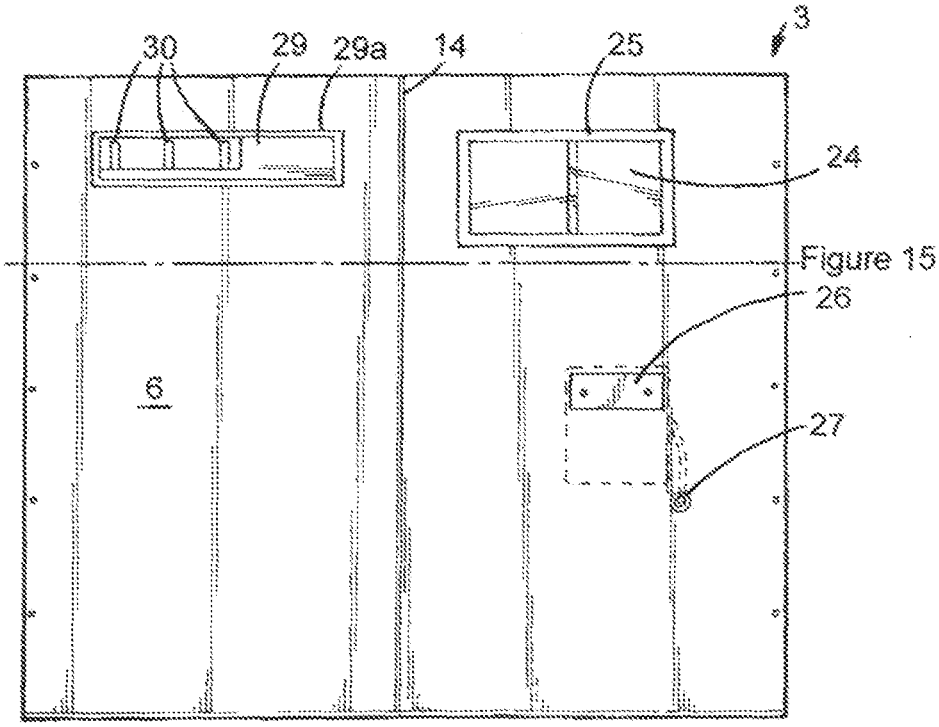
FIG. 8 is a rear view of a first side wall of the present invention.

FIG. 7 is a front view of a first side wall of the present invention, and FIG. 8 is a rear view of a first side wall of the present invention. The front view shows the outer (exterior) face of the first side wall 3, and the rear view shows the inner (interior) face of the first side wall 3. As noted above, the outer face of the first side wall 3 is preferably covered with 600-denier polyester tent-grade material 7, and the inner face of the first side wall 3 is preferably covered with 12-ounce duck canvas 6. As shown in this figure, the first side wall 3 preferably comprises a window 24 made of acrylic in sheet form with a wood frame 25. The interior of the first side wall 3 preferably comprises a bracket 26 upon which a portable heater (not shown) may be hung. The first side wall also preferably comprises a conduit 27 for electrical cables for use in connection with a heater, generator, or similar equipment. This figure shows the grommet holes 28 that are used to connect the side walls 3 to the front and rear walls 1, 2.

Each of the two side walls 3 preferably comprises a coat/towel rack 29 that is constructed similarly to the shelf 18 described in connection with FIG. 4. The coat/towel rack 29 is recessed into the side wall 3 and pivots outward and downward when in use (see FIG. 11). Barrel hinges (not shown) attach the coat/towel rack 29 to the wood frame 29*a* around the coat/towel rack. The coat/towel rack 29 comprises pegs 30 upon which coats, towels, etc. may be hung. The coat/towel rack 29 can also serve as a shelf for tackle or personal items.

Figure 9:
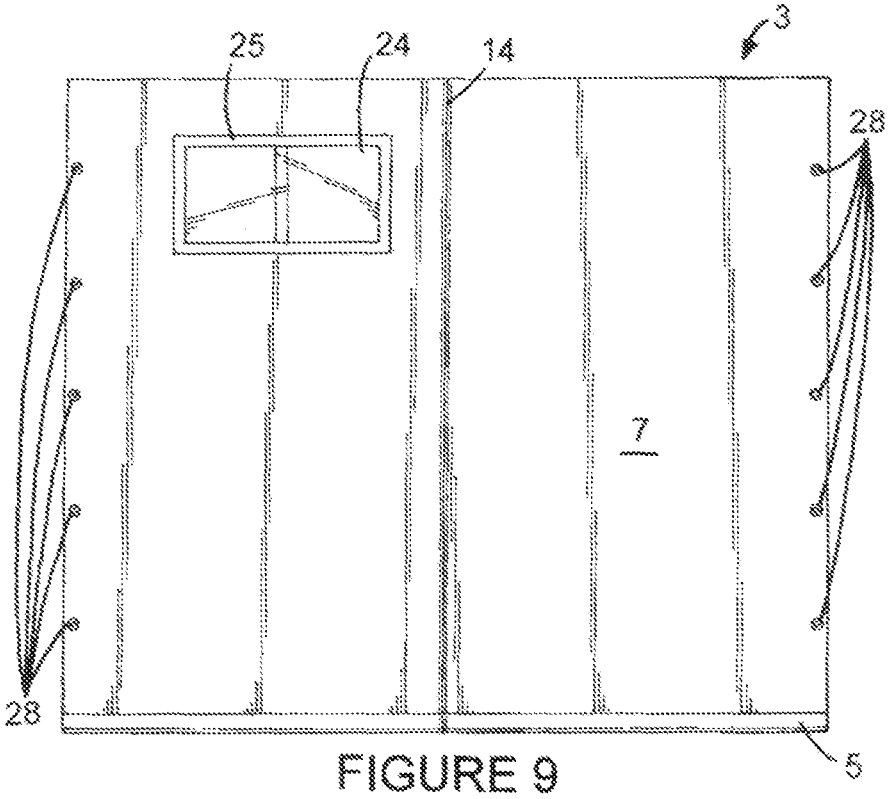
FIG. 9 is a front view of a second side wall of the present invention.
Figure 10:
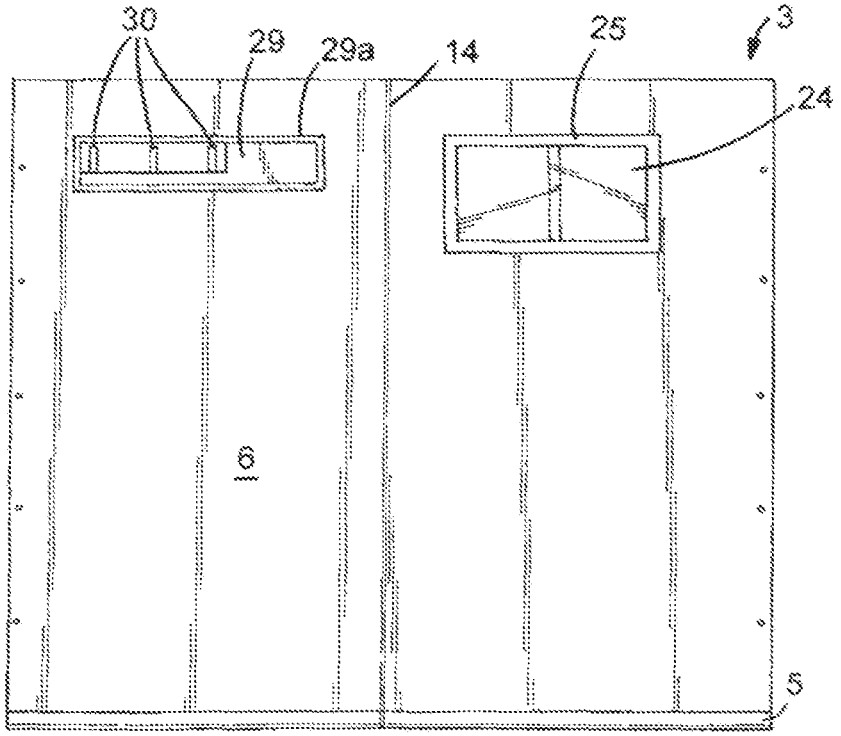
FIG. 10 is a rear view of a second side wall of the present invention.

FIG. 9 is a front view of a second side wall of the present invention, and FIG. 10 is a rear view of a second side wall of the present invention. The front view shows the outer (exterior) face of the second side wall 3, and the rear view shows the inner (interior) face of the second side wall 3. As noted above, the outer face of the second side wall 3 is preferably covered with 600-denier polyester tent-grade material 7, and the inner face of the second side wall 3 is preferably covered with 12-ounce duck canvas 6. The second side wall is identical to the first side wall except that it does not include the heater bracket 26 or conduit 27.

Figure 11:
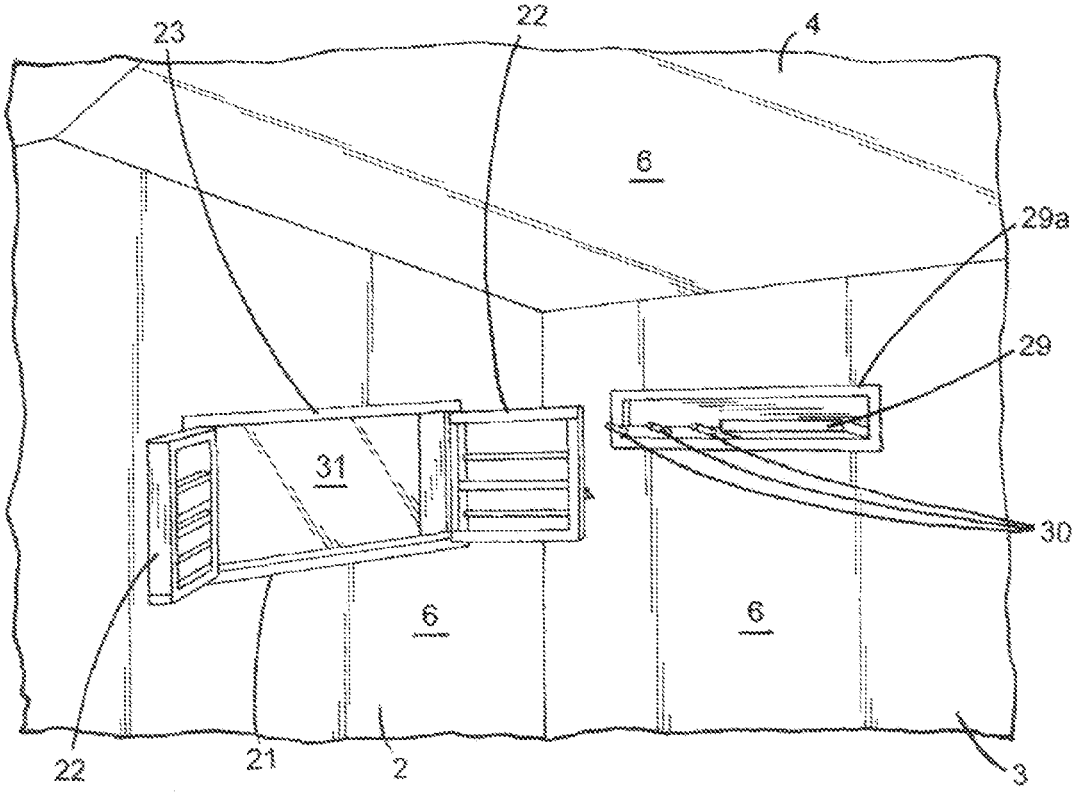
FIG. 11 is a detail perspective view of the medicine cabinet and coat/towel rack of the present invention.
Figure 12:
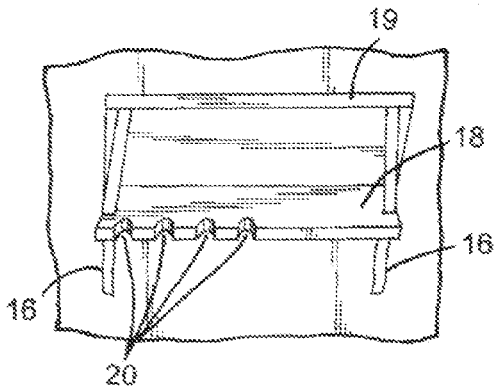
FIG. 12 is a detail perspective view of the shelf of the present invention.

FIG. 11 is a detail perspective view of the medicine cabinet and coat/towel rack of the present invention. In a preferred embodiment, a mirror 31 (preferably comprised of acrylic in sheet form) lies behind the medicine cabinet 21 so that it is exposed when the medicine cabinet is opened. The coat/towel rack 29 has been, previously described and is shown in an open position. FIG. 12 is a detail perspective view of the shelf of the present invention. The shelf has also been previously described and is shown here in an open position.

Figure 13:
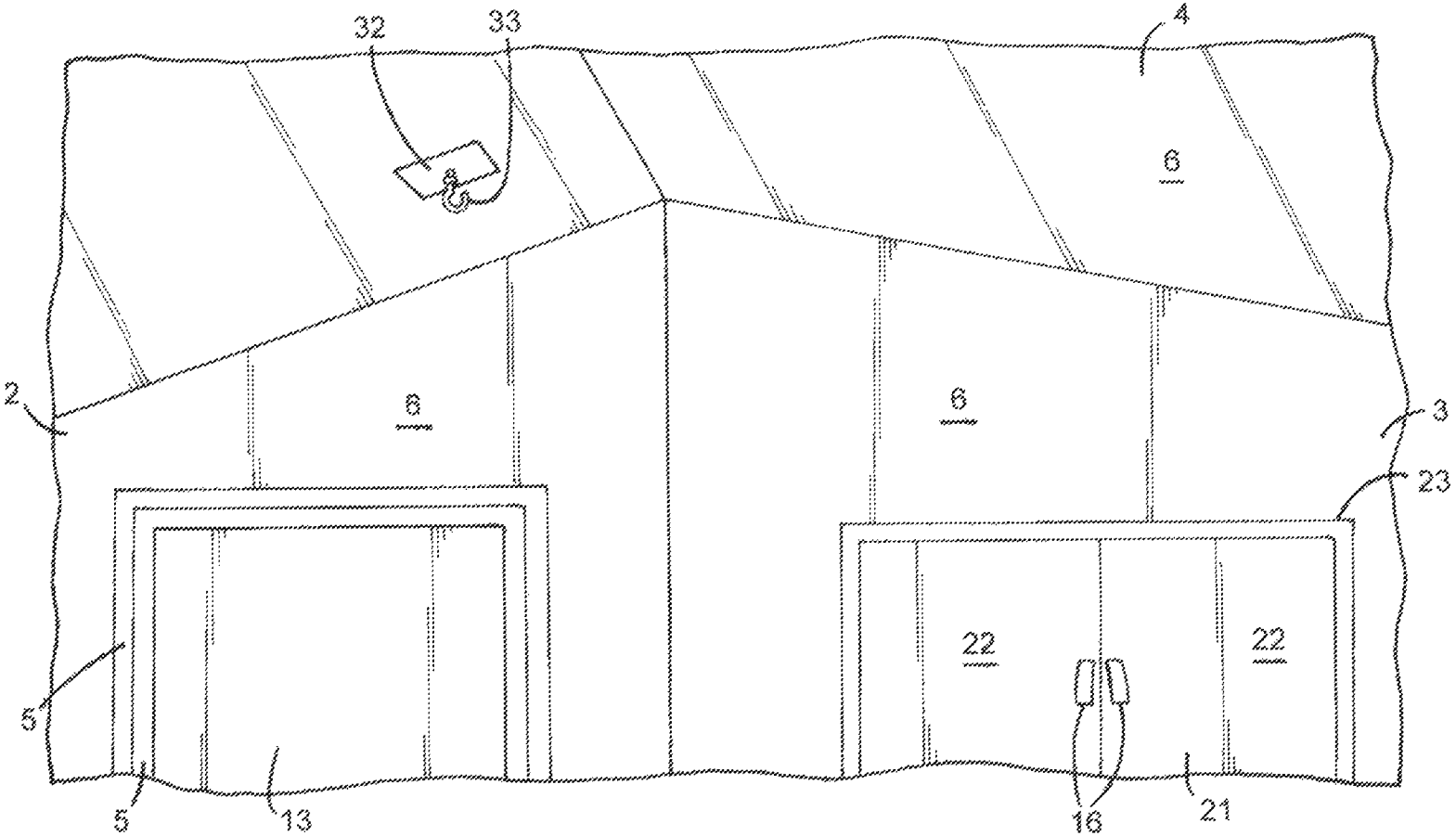
FIG. 13 is a detail perspective view of the ceiling feature of the present invention.

FIG. 13 is a detail perspective view of the ceiling feature of the present invention. In a preferred embodiment, the ceiling (which is the underside of the roof member 4) comprises a fastening block 32 into which a hook 33 may be screwed. The hook may be used to hang a lamp or lantern.

Figure 14:
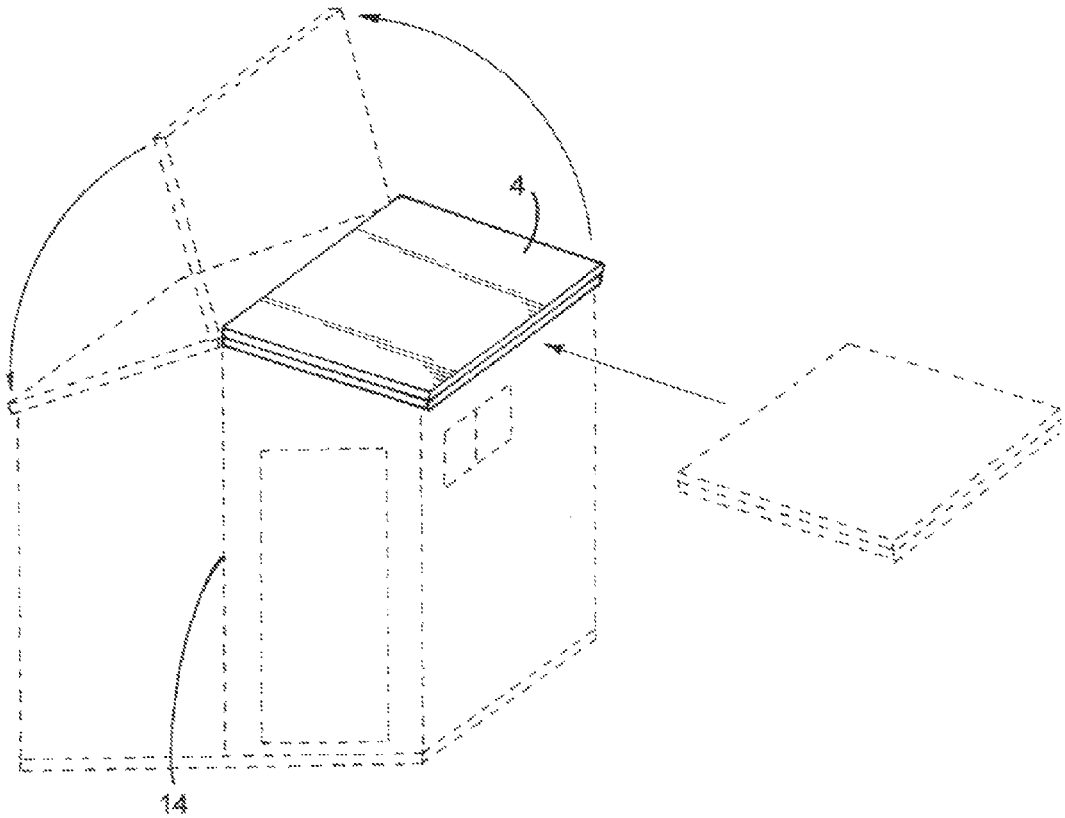
FIG. 14 is a diagram illustrating the installation of the roof member of the present invention.

FIG. 14 is a diagram illustrating the installation of the roof member of the present invention. As explained above, once the four walls 1, 2, 3 are secured to each other with bolts, the roof member 4 is lifted onto the top of the structure in a folded position, and one of the panels of the two-panel roof member 4 is situated on top of one-half of the structure with the canvas seam 14 (not shown) separating the two panels of the roof member 4 aligned with the canvas seams 14 of the front and rear walls. The second panel of the two-panel roof member (this would be the top-most panel in FIG. 14) is then folded outward and away from the first panel of the two-panel roof member at the canvas seam until it covers the second part of the structure. Once the roof member 4 is thus situated, then the roof ties 10 and ratchet straps 11 are affixed, as previously described. The only tool needed to construct the present invention is a 7/16" nut driver, which his used to screw in the bolts that attached the walls to each other and the roof to the walls, as discussed above. No other tools are needed.

Figure 15:
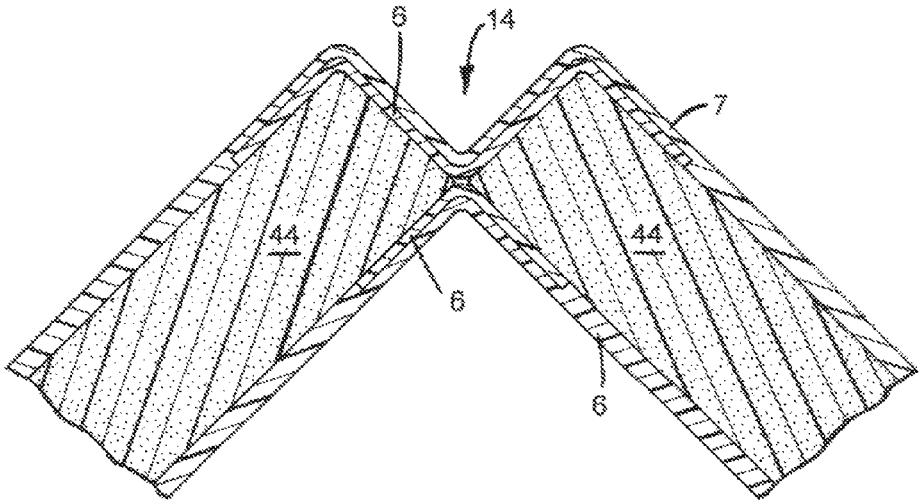
FIG. 15 is a section view of the canvas seam of the present invention.

FIG. 15 is a section view of the canvas seam of the present invention. The point at which this section view is taken is indicated on FIG. 8, except that the panels 44 comprising the side wall 3 are partially unfolded in FIG. 15. As shown in FIG. 15, the canvas seam 14 is preferably comprised of two layers of duck canvas 6, one on either side of the panels 44 at the point of joinder. The method of creating the canvas seam is discussed in connection with FIGS. 19 and 20 below. The inner fabric (preferably duck canvas 6) and outer fabric (preferably 600-denier polyester tent-grade material 7) are preferably adhered to the panels 44 after the canvas seam 14 is in place (i.e., on top of the canvas seam 14).

Figure 16:
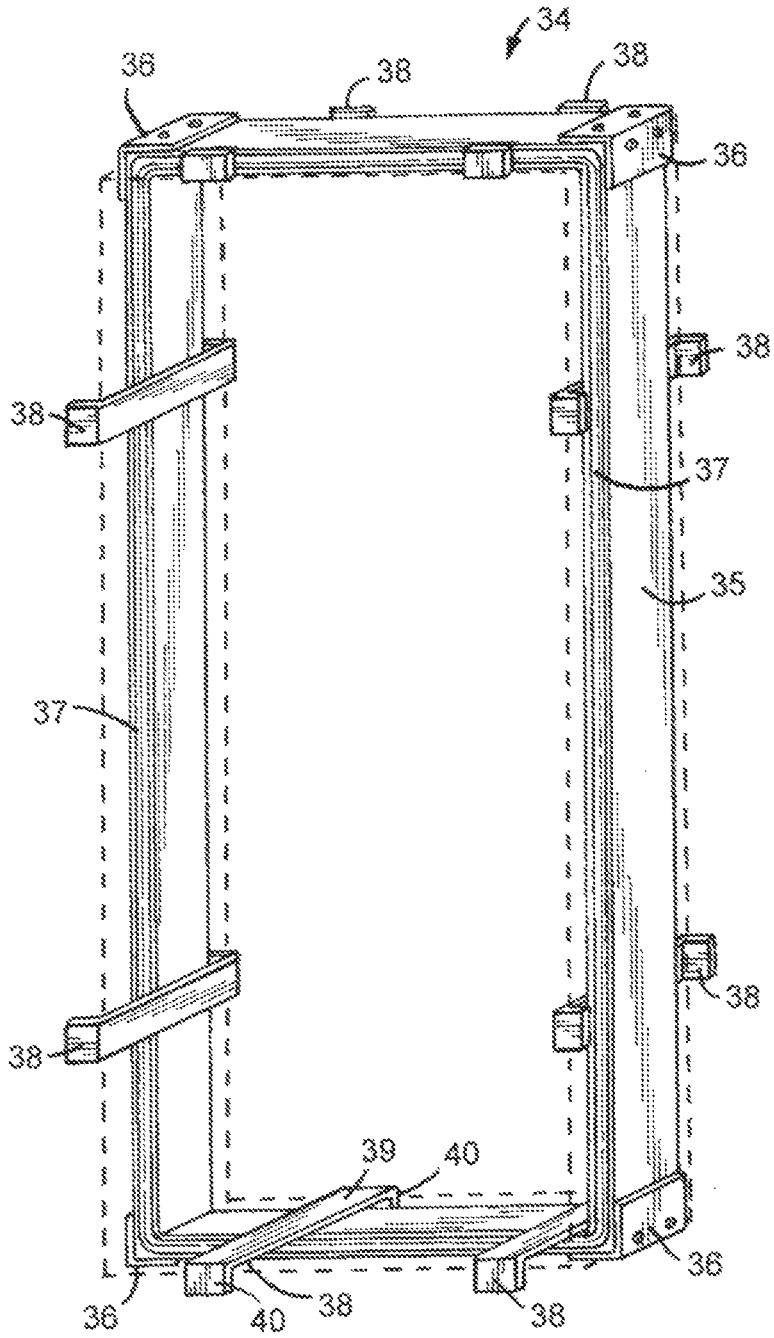
FIG. 16 is a perspective view of the boot and boot locks of the present invention.
Figure 17:
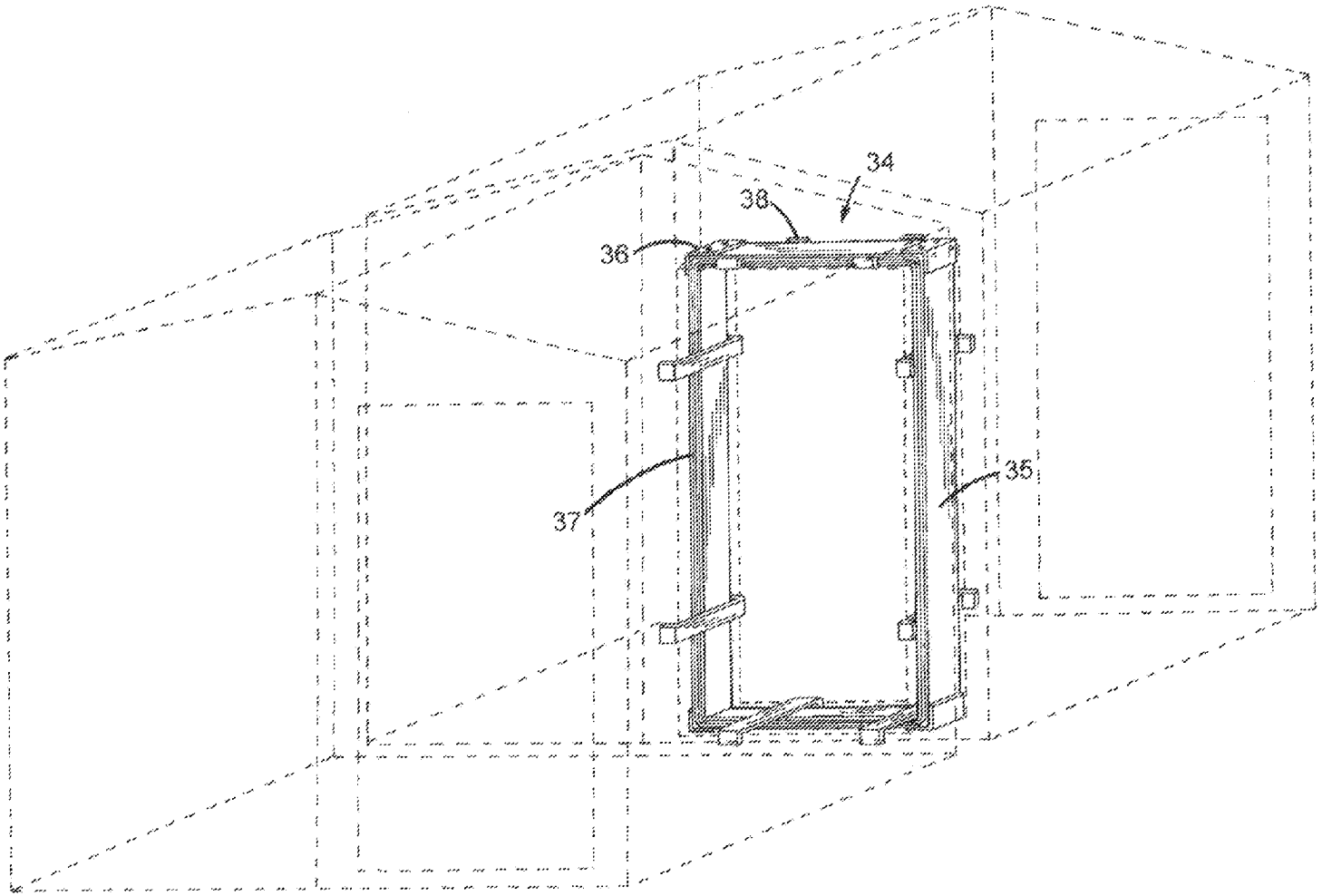
FIG. 17 is a diagram illustrating how the boot and boot locks of the present invention join two modular structures together into a single unit.

FIG. 16 is a perspective view of the boot and boot locks of the present invention, and FIG. 17 is a diagram illustrating how the boot and boot locks of the present invention join two modular structures together into a single unit. As shown in these figures the boot 34 is of roughly the same shape (rectangular) and size (height and width) as the door frame 13*a* in the rear wall 2. The boot 34 is comprised of a frame 35, which may be constructed of wood or any other suitable material. In this case, the corners of the frame 35 are held together by metal braces 36, but the present invention is not limited to any particular method of joining or forming the corners of the frame 35. A rubber gasket 37 is adhered (or otherwise joined) to the entire perimeter of the frame 35 on both sides of the boot 34, as shown in FIG. 16. This rubber gasket 37 creates a seal when two units are joined together and the boot locks 38 are in place.

The boot locks 38 are brackets, preferably comprised of metal, that have a longitudinal section 39 and two end sections 40 that protrude from either end of the longitudinal section at a ninety (90)-degree angle from the longitudinal section. Eight boot locks 38 are shown in FIG. 16, but the present invention is not limited to any particular number of boot locks.

To join two structures together, the door 13 on the front or rear wall 1, 2 is removed (by removing the pins from the pin hinges 15 and lifting the door off), and the boot 34 is lined up with the door frame 13*a*. Similarly, the door 13 on the front or rear wall 1, 2 of the second structure is removed in the same manner, and the boot 34 is also lined up with the door frame 13*a* on the second structure. Each boot lock 38 is roughly the width of the boot 34 plus two walls (rear and rear, front and front, or front and rear). The boot locks 38 are situated as shown in FIGS. 16 and 17 so that they span the width of the boot lock and the front/rear wall of the first structure and the front/rear wall of the second structure. In other words, the inside of the door frame 13*a* on the front/rear wall of the first structure is placed inside of the boot lock on one side of the boot 34, and the inside of the door frame 13*a* on the front/rear wall of the second structure is placed inside of the boot lock on the other side of the boot 34. Thus, each boot lock 38 holds, in, order, the width of the front/rear wall on the first structure, the width of the boot itself, and the width of the front/rear wall on the second structure.

As noted above, when the boot locks are in place, they compress the rubber gasket 37 on the boot 34, thereby creating a seal between the two structures. Note that the heater bracket 26 is preferably situated close to the door 13 on the rear wall 2 so that the portable heater (not shown) can heat two structures when they are joined with the boot 34. To decouple the two structures, the boot locks 38 and boot 34 are removed, and the doors 13 are placed back on the door frames 13*a* of the respective structures. Note that any number of units may be joined together in the manner described herein.

Figure 18:
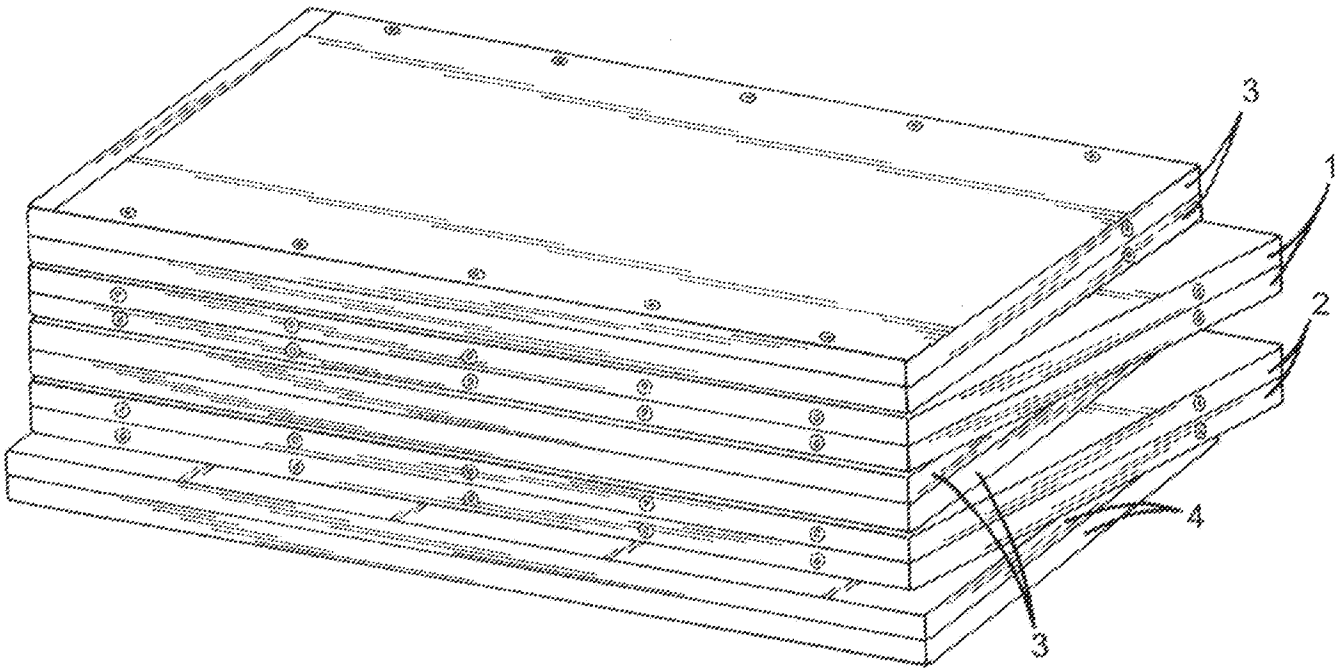
FIG. 18 is a perspective view of the present invention in a fully collapsed position ready for transport or storage.

FIG. 18 is a perspective view of the present invention in a fully collapsed position ready for transport or storage. As shown in this figure, when disassembled and stacked, the present invention is only 25 inches high (i.e., ten 2.5-inch wide panels). This feature makes the present invention particularly suitable for transportation and hauling into the field, if necessary.

Figure 19:
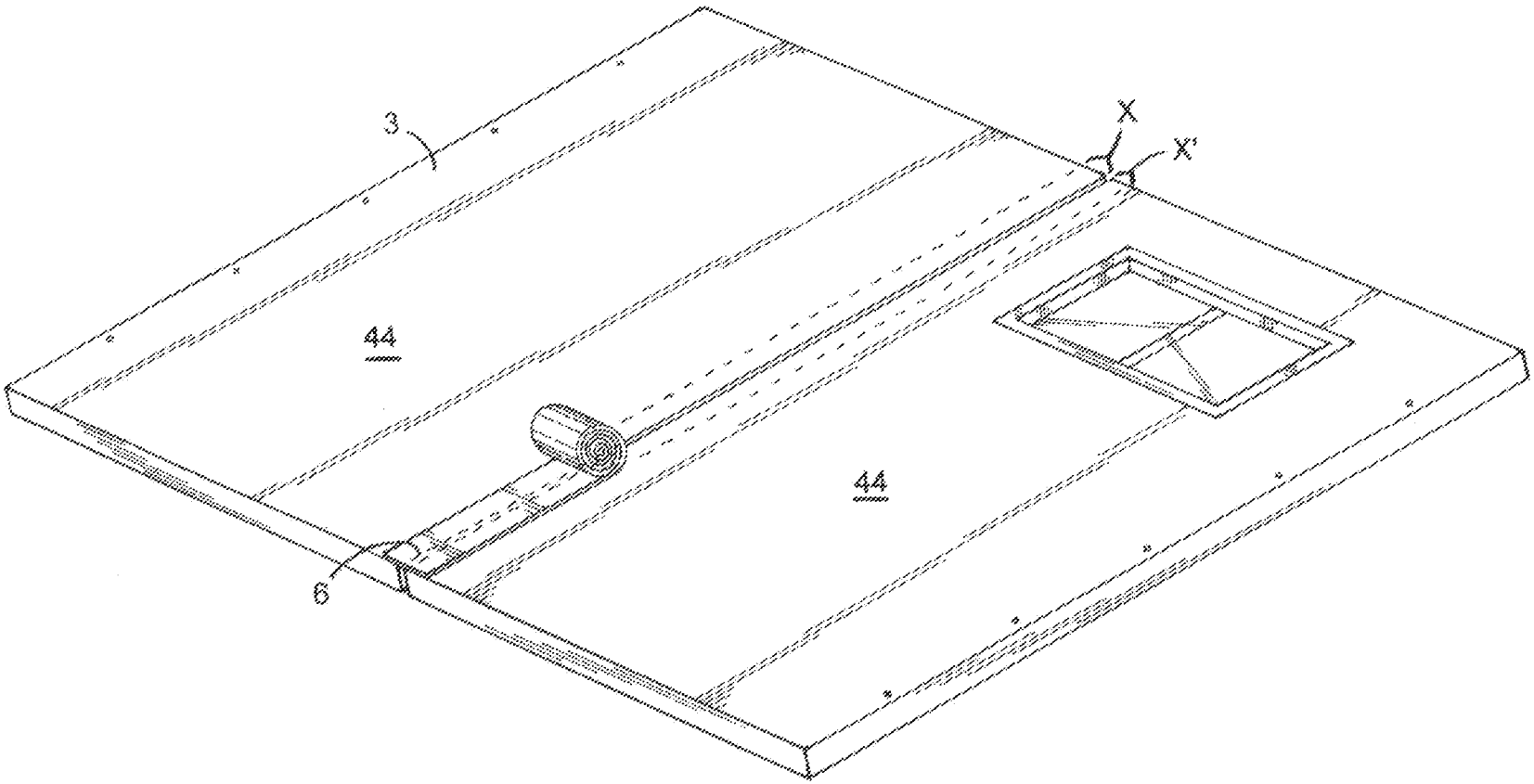
FIG. 19 is a first perspective view of a side wall showing how the canvas seam is constructed.
Figure 20:
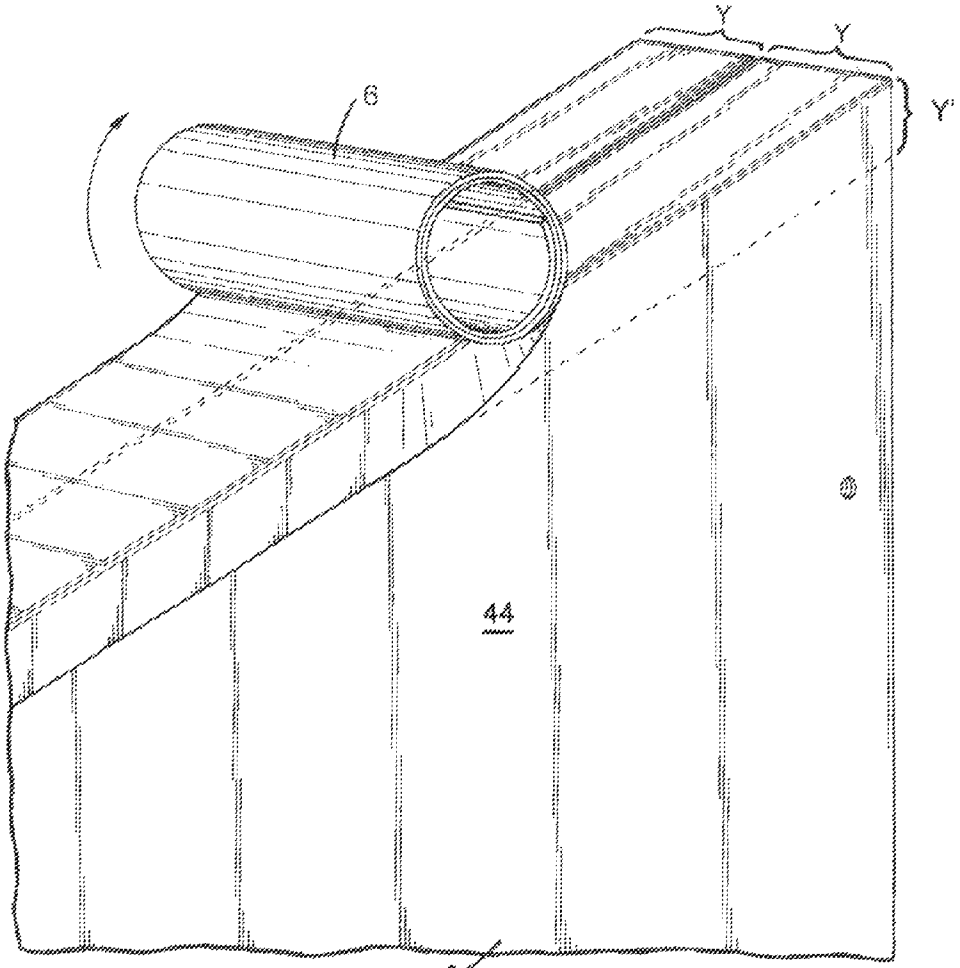
FIG. 20 is a second perspective view of a side wall showing how the canvas seam is constructed.

FIGS. 19 and 20 show how the canvas seam 14 of the present invention is constructed. First, two panels (in this case, the two panels comprise the side wall 3, but any two panels of any of the front, rear or side walls or of the roof member could be used) are situated adjacent to one another, as shown in the figure. Second, a bonding agent (preferably a latex-based adhesive) is applied to each panel along the edge of the panel that will comprise the canvas seam (see X and X' on FIG. 19). Third, a four-inch strip of duck canvas 6 is applied to each panel on top of the bonding agent, as shown. This creates the inside portion of the canvas seam. The next step in the process is shown in FIG. 19.

Next, the two panels are folded toward one another along the inside portion of the canvas seam, and bonding agent is applied to the inside edges (see Y and Y') of each panel. A nine-inch strip of duck canvas 6 is applied to each panel on top of the bonding agent, as shown. This creates the outside portion of the canvas seam. Once the canvas seam has been made, the panels are unfolded, and vinyl flashing is applied to the top and side edges of each panel.

Next, bonding agent is applied to the entire inside face of each panel (i.e., the face of the panel that will comprise the inside of the structure), and duck canvas 6 is applied over the bonding agent to create the inner surface of the wall. The panels are then folded together again (as shown in FIG. 20), bonding agent is applied to the entire outside face of each panel (i.e., the face of the panel that will comprise the outside of the structure), as well as to the inside edges (see Y in FIG. 20) of each panel, and 600-denier polyester tent-grade material is applied over the bonding agent to create the outer surface of the wall. Lastly, vinyl flashing is applied to the bottom edge of each panel.

By creating the canvas seam 14 in this manner—that is, with an inside portion that is shorter in width than the outside portion and by applying the inside portion with the panels unfolded (as shown in FIG. 19) and the outside portion with the panels folded (as shown in FIG. 20)—the inventor has ensured that the walls can only unfold-in one direction. Note that the 600-denier polyester tent-grade material 7 on the outside face of each wall is applied in the same manner as the outside portion of the canvas seam (that is, with the panels folded), and the duck canvas 6 on the inside face of each wall is applied in the same manner as the inside portion of the canvas seam (that is, with the panels unfolded). This too ensures that the walls can only unfold in one direction.

Figure 21:
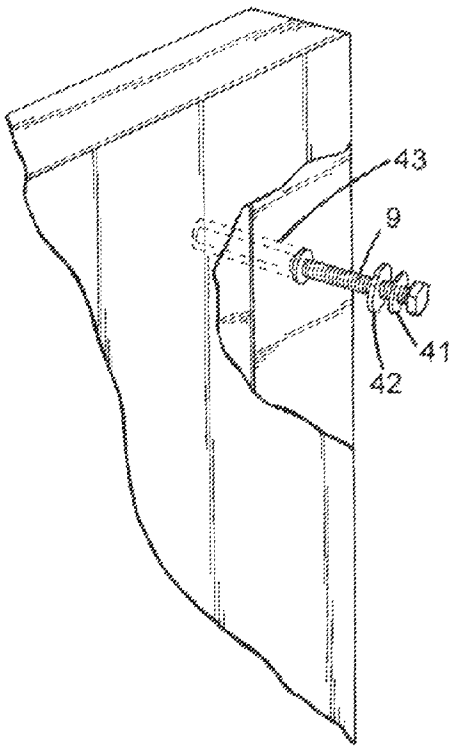
FIG. 21 is a detail perspective view of the nylon bushing of the present invention.

FIG. 21 is a detail perspective view of the nylon bushing of the present invention. In a preferred embodiment, a nylon bushing 43 is installed into the panel (comprising any of the four walls or roof member) at the point where a bolt 9 is inserted into the panel. Referring to FIG. 2, in the embodiment shown, there would be eight nylon bushings in the panels of the roof member 4 (four on each panel comprising the roof member), and there would be ten nylon bushings in each side wall 3 (five on each panel comprising the side wall). The purpose of the nylon bushing is to stabilize the bolt and prevent the foam panels from collapsing when the bolts are tightened.

Figure 22:
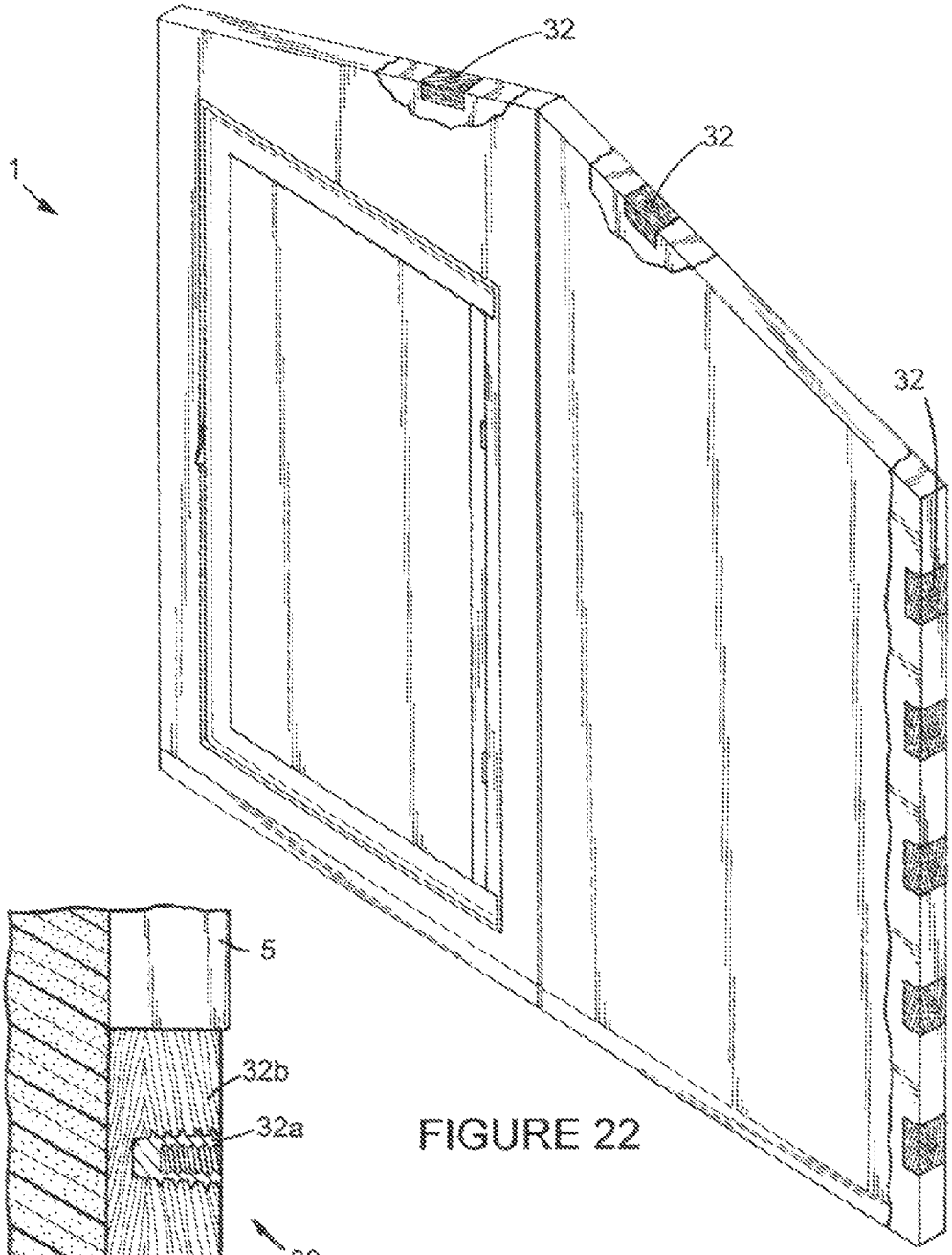
FIG. 22 is a perspective view of the fastening block of the present invention.

FIG. 22 is a perspective view of the fastening blocks of the present invention. In a preferred embodiment, fastening blocks 32 are installed in the foam panels 44 wherever a bolt is inserted into the panel (but not where the bolt passes through a panel). For example, referring to FIG. 2, fastening blocks 32 would be installed on the top and side edges of the front wall, on the top and side edges of the rear wall 2, and on the top edges of the side walls 3.

Figure 23:
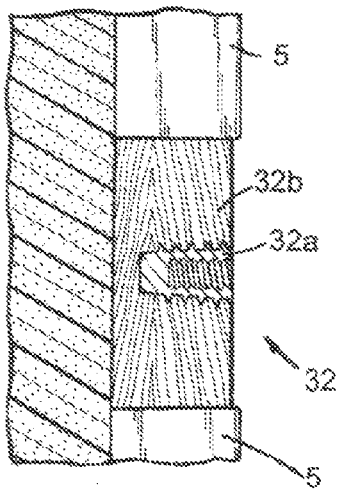
FIG. 23 is a section view of a fastening block.

FIG. 23 is a section view of a fastening block. As shown in this figure, the threaded insert 32 comprises a threaded metal insert 32 surrounded by a wood block 32*b*. In this figure, the flashing 5 has been cut away and the inner/outer fabric 6, 7 omitted to show the fastening block 32. (Similarly, the flashing 5 and inner/outer fabric 6, 7 has been cut away in FIG. 22 to reveal the fastening blocks 32). The fastening blocks ensure that the bolts 9 will be securely held in the foam panels 44.

Although the preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

I claim:

1. A collapsible structure comprising four collapsible walls and a roof member, each of the four walls and collapsible roof member comprising two foam panels joined by a canvas seam further comprising a door frame, a boot and a plurality of boot locks;

wherein the boot is roughly the same shape and size as the door frame;

wherein the boot comprises a frame with a first side and a second side, a rubber gasket that is joined to the first side of the frame, and a rubber gasket that is joined to the second side of the frame;

wherein each boot lock is a bracket comprising a longitudinal section and two end sections that protrude from either end of the longitudinal section at roughly ninety-degree angles; and wherein each boot lock is roughly the width of the boot plus two walls.

2. The collapsible structure of claim 1, wherein the boot and boot locks join two collapsible structures together, and wherein the rubber gaskets create a seal between the two structures.

* * * * *